United States Patent [19]

Sakai

[11] Patent Number: 5,009,733

[45] Date of Patent: Apr. 23, 1991

[54] PROCESS FOR FABRICATING A CIRCULAR FRAME

[76] Inventor: Mieko Sakai, 12-8, Shinbashi 6-chome, Minato-ku, Tokyo, Japan

[21] Appl. No.: 373,307

[22] Filed: Jun. 28, 1989

[30] Foreign Application Priority Data

Jul. 11, 1988 [JP] Japan ..... 63-173423

[51] Int. Cl.[5] ..... B27H 1/00

[52] U.S. Cl. ..... 156/184; 144/268; 156/446

[58] Field of Search ..... 144/268, 258, 259; 156/18, 446

[56] References Cited

U.S. PATENT DOCUMENTS

| | | | |
|---|---|---|---|
| 1,643,487 | 9/1927 | Craig | 144/268 |
| 1,645,936 | 10/1927 | Schlesinger | 144/268 |
| 2,269,634 | 1/1942 | Michaelis | 144/259 |
| 2,287,121 | 6/1942 | Newhouse | 144/268 X |
| 2,321,738 | 6/1943 | Farny | 144/268 |
| 2,322,677 | 6/1943 | Walt et al. | 144/268 |
| 2,353,957 | 7/1944 | Frid | 144/268 |
| 2,579,800 | 12/1951 | Cress | 144/262 X |
| 2,616,463 | 11/1952 | Potchen | 144/268 |
| 4,311,176 | 1/1982 | Cavallarin | 144/268 |

*Primary Examiner*—David A. Simmons

*Attorney, Agent, or Firm*—Armstrong, Nikaido, Marmelstein, Kubovcik, & Murray

[57] ABSTRACT

A multi-layer circular wooden frame of the type used as a steering wheel or hand rail for a chair is provided using a machine which includes a cylindrical forming shell rotatably mounted to a support, a plurality of pressing rolls disposed around the forming shell and movable toward and away from the shell, first and second feeding rollers and a reed which are also movable toward and away from the cylindrical shell. An elongate feeder is pivotally mounted so that one end is disposed for movement toward and away from the cylindrical shell and for delivering one end of a flat strip of wooden board into a passageway to be provided between the feeding rollers, pressing rolls, reed and the cylindrical shell. One end of a flat strip of wooden board is delivered between the first feeding roller and the cylindrical shell, the feeding rollers and pressing rolls are moved to a position closely adjacent the cylindrical shell and then the cylindrical shell and pressing rolls are rotated to wrap the flat strip of wooden board around the exterior surface of the cylindrical shell. A second layered strip of wooden board having adhesive applied thereto is then wrapped by the machine components around the outer surface of the first wrapped board.

2 Claims, 4 Drawing Sheets

PROCESS FOR FABRICATING A CIRCULAR FRAME

FIELD OF THE INVENTION

This invention relates to a process and apparatus for fabricating or molding a circular frame article from wooden material, which wll find application in the manufacture of a steering wheel, hand rail for a chair or other products such as room interior ornaments.

DESCRIPTION OF THE CONVENTIONAL ART

Conventionally, wooden circular frames have been manufactured manually with attendant disadvantages; for example of low productivity and poor quality control.

This invention intends to overcome the disadvantages of the conventional art and to offer a mechanical apparatus and process for fabricating or molding a circular frame body from a flat, slender wooden material.

In the manufacture of plywood products, board components are layered with adhesive the between the board surfaces to form a lamination, while the applied adhesive is kept uncured. Then, the lamination is pressed and the adhesive is cured. This invention is, in an analogous manner of speaking relative to the above described manufacture of plywood products, comparable to press-forming the plywood at products pre-cure stage.

SUMMARY OF THE INVENTION

This invention is based an apparatus which comprises a drum , having a diameter which may be changed according to a desired product size cooperating units are arranged around the drum, to form a passage for a wooden material to veer or to or wrap around the drum shell, while providing flexibility of accepting materials of differnt thicknesses, and then to press or to clamp the encircled material onto the drum shell in order to impress mechanical pressure. A further unit for treating or pressing a front tip of the wooden material which, of itself, has no adaptability to a veering act is also provided.

DESCRIPTION OF THE EMBODIMENTS

Figure 3A:
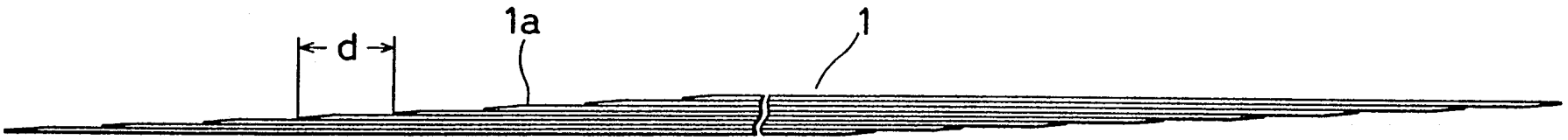
FIGS. 3(*a*)–3(*b*) show side elevations of materials to be applied to the process of the present invention, wherein FIG. 3(*a*) shows a type of lamination, FIG. 3(*b*) shows a type of non-laminated or single lengthy material, and FIG. 3(*c*) shows a single material which will be used together with the material shown in FIG. 3(*a*).
Figure 3B:
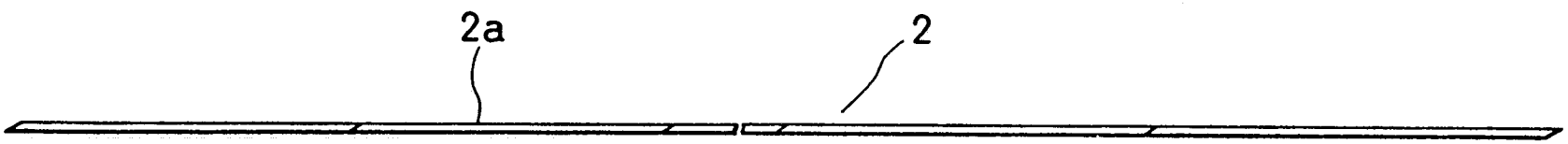
Figure 3C:
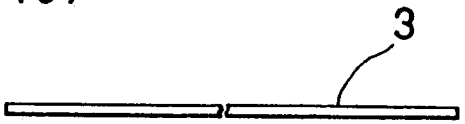

FIG. 3(*a*) shows, as noted above, a side elevation of a material to be applied to the inventive process wherein the material 1 is a type of lamination made of flat boards

1*a* of beech, for example, and the lamination is formed in layered steps with a prescribed step. The flat boards 1*a* have usually such measurements as 1–3 mm in thickness, 5–15 cm in width, and 1–3 m in length. The step-length space d is usually 2–8 cm and 10 to 20 plys of boards are usually layered together. A urea based or phenol based adhesive has been customarily applied between these boards, but the adhesive is kept uncured until after the lamination is shaped.

Turning to FIG. 3(*b*), this shows a single layer of a lengthy board 2 in which a piece of board 2*a* having a comparable length as a board 1*a*, previously mentioned, is provided with scarf cuts, shown by beveled lines, and the two ends of the boards 2*a* are connected endways to one another longitudinally. The connections are achieved by the art of high-frequency adhesion, for instance.

Figure 1A:
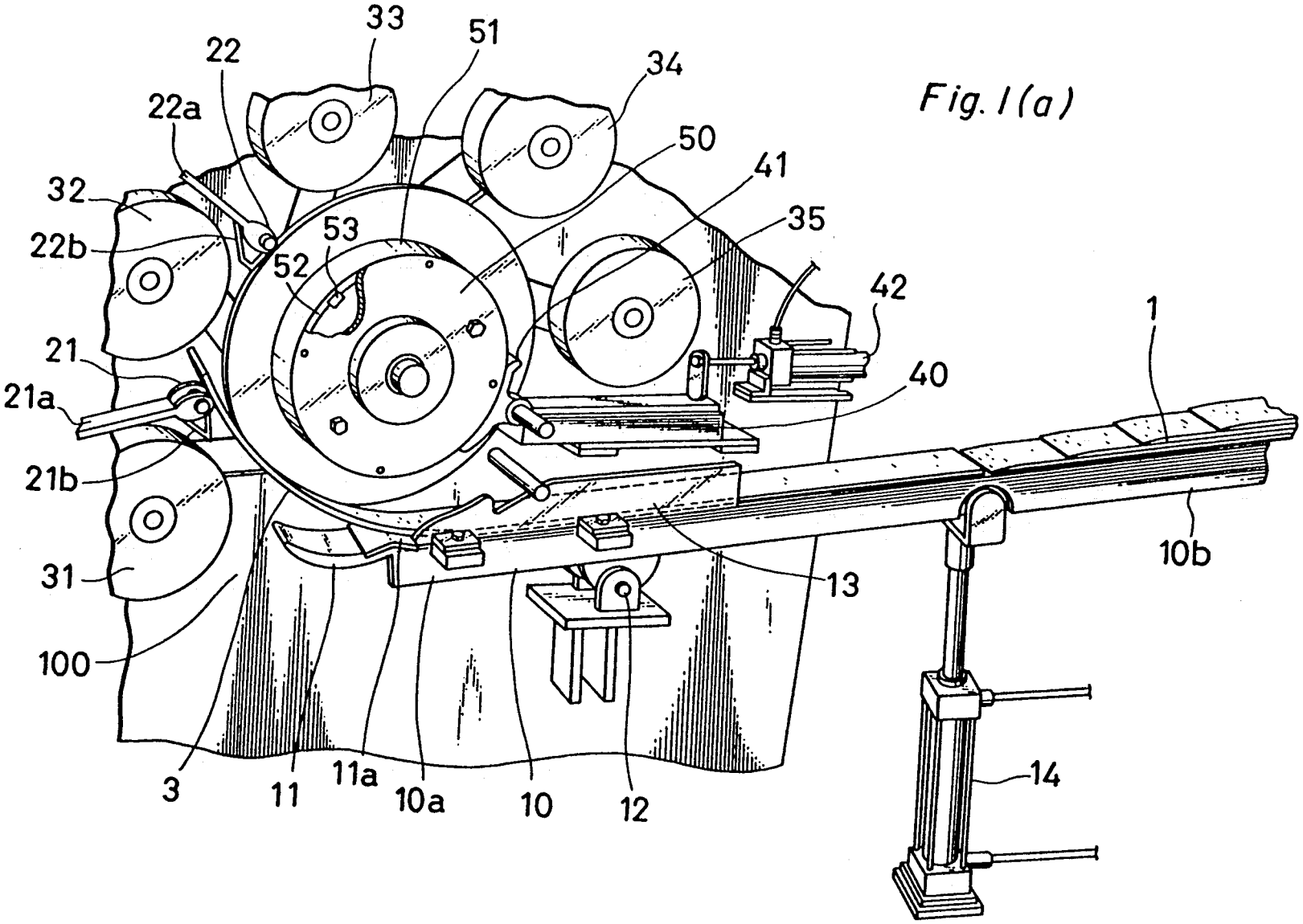
FIGS. 1(*a*) and 1(*b*) show perspective views, partly broken, of an apparatus to achieve the working of the inventive process, wherein FIG. 1(*a*) shows a state wherein a first reed, first and second free rollers, and pressing rolls are kept detached or withdrawn from a shell of a drum, and FIG. 1(*b*) shows a state wherein these elements are moved toward the drum shell.
Figure 1B:
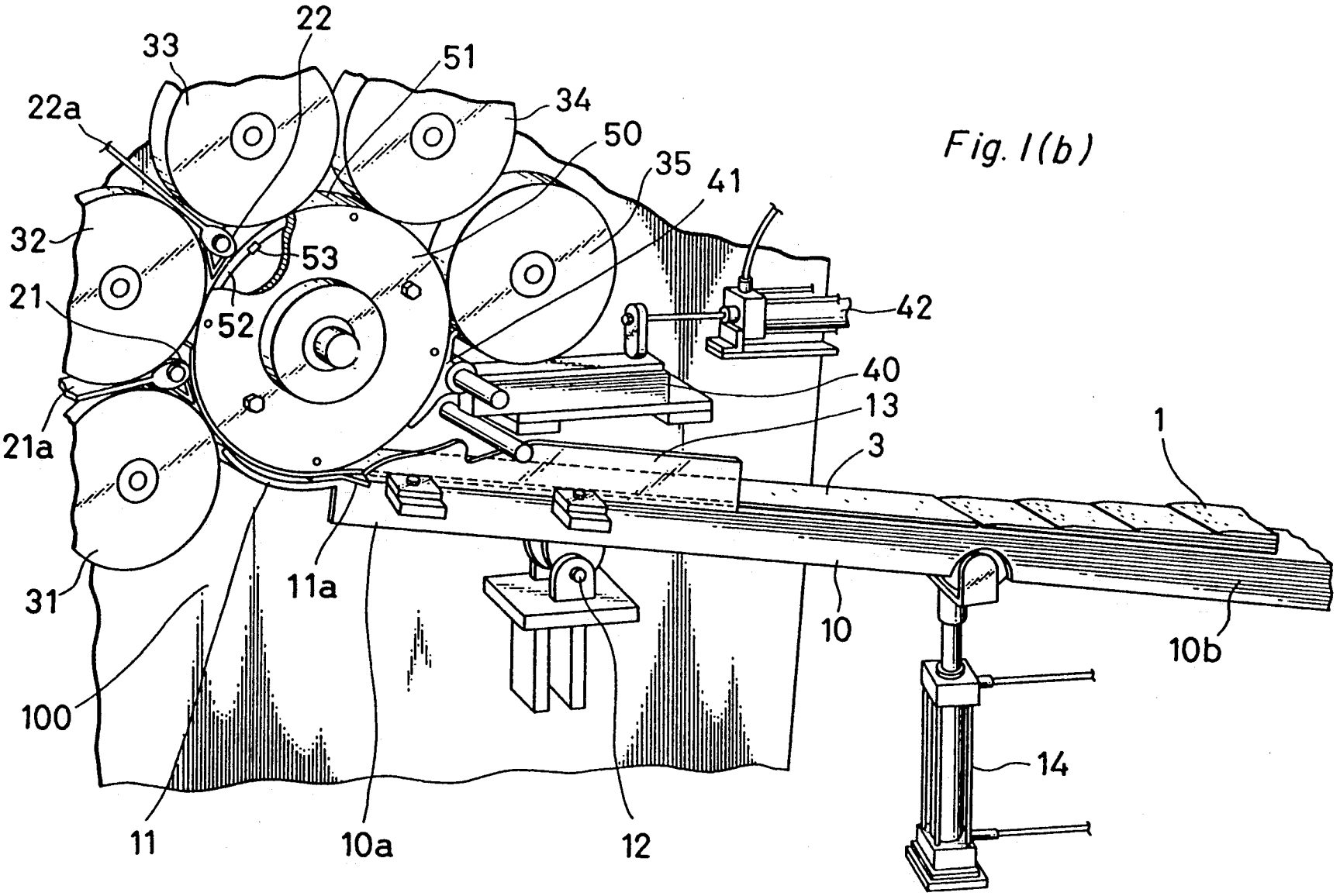
Figure 2A:
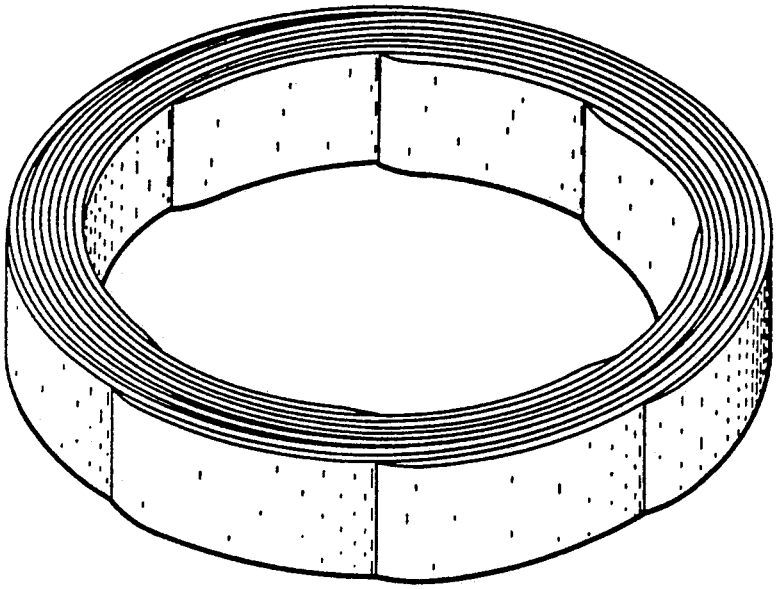
FIG. 2 shows perspective views of two types of products, wherein the product of FIG. 2(*a*) is made of laminated material and the product of FIG. 2(*b*) is made of winding of single lengthy material.
Figure 2B:
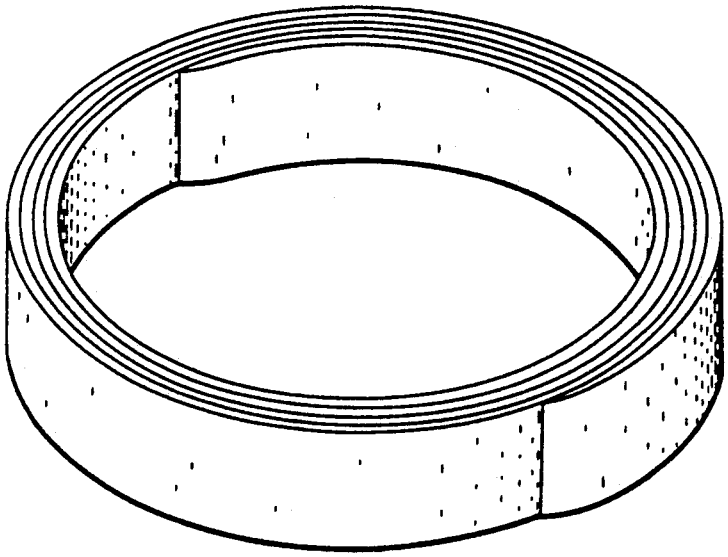

With reference to FIG. 1, the two drawings of FIG. 1(*a*) and 1(*b*) show, as mentioned above, the two states that the first reed, the first and second free rollers, and rolls are kept detached from the drum shell, and attached thereon, which will be apparent later.

Specifically mentioning more specifically the apparatus 100 of the invention for producing a circular frame from a material board 1 or 2, is generally comprised of a feeder 10, a drum 50, first and second reeds 11, 41 first and second free rollers 21, 22, and pressing rolls 31–35.

The feeder 10 is of elongate form and comprises generally a guideway groove of U-shape in section which is pivotably supported longitudinally by an axis 12 which is positioned under a midsection of the feeder 10. At the front end 10*a* thereof, the first reed 11 like a jaw in shape is provided. Bridging over the front end 10*a* and the first reed 11 is a stride piece 11*a*, which like a piece of herringbone, is of angular cross-section in shape. Toward the front end 10*a* of upstanding the feeder 10, a pair of guide plates 13 are provided. Further, under a midpoint of a rear end 10*b* of the feeder 10, a hydraulic cylinder 14 is provided generally vertically to the feeder 10 to effect a pivotal action about the axis 12. Referring to the drum 50, this is designed to turn (clockwise in view) by a drive unit (not shown) with a plate 52 forming a cylindrical forming shell 51. The shell plate 52 usually made of steel, is removably attached with the aid of keys 53 (one of them is seen) The plate 52 forms the shell 51 of the drum and determines an inner diameter of a circular product to be produced. In the following, a passage for receiving source material and encircling around the shell 51 is assumed to start at about the front end 10*a* of the feeder 10 and to end there.

The two free rollers, first and second, 21, 22, are operatively connected respectively to air cylinder 21*a*, 22*a* with mobility for movement toward or away from the drum shell 51 and they are normally arranged to be around, preferably around the first half of the perimeter of the shell 51, and adjacent to the shell 51 with a space between each other, each tip of a roller 21 or 22, a guide 21*b* or 22*b* in the shape of a triangle is attached at the upstream side of each roller with a side of the triangle forming a guide to an on-coming source or raw material so that the rollers 21, 22 and the guides 21*b*, 22*b* will be pressed by the cylinders 21*a*, 22*a* toward the drum shell 51. Further, pressing rolls 31–35, five rolls in view, are arranged also around the drum shell 51 wherein a few of them are positioned forming a series mixed with the two free rollers 21 and 22. The pressing rolls 31–35 are also designed to turn counterclockwise in view and to have mobility permitting movement toward or away from the shell 51 by respective drive units, not shown.

A second reed 41 is positioned toward the end of the encircling passage and is operatively connected to a slider 40, which is designed to be moved by an air cylinder 42 so that the second reed 41 will be pressed toward the drum shell 51 by action of the cylinder 42.

In operation:

First, the circular plate 52 is mounted with the drum 50 to form a shell face 51, which will determine a size of an intended product.

All free rollers 21, 22 and pressing rolls 31–35 are by respective drive units kept to be detached or withdrawn from the shell face 51, and the second reed 41 is pressed thereon by the cylinder 42.

In the meantime supply, material boards should be prepared in the area of the feeder 10. Specifically, an initial single plate or non-laminated board 3 which is free of adhesive is laid on the feeder 10. The feeder is pivoted to be high rearward, following which act the single board 3 is slid out of the feeder end 10*a*, sometimes with aid of manual handling, over the stride piece 11*a* and the first reed 11 to veer upward and to advance into a space generally formed between the shell face 51 and rolls 31 and 32. When the front tip of the entered board 3 has reached the first free roller 21, as is shown in FIG. 1 (*a*), the two free rollers 21, 22 are urged to press the board 3 onto the shell face 51, by which action a front portion of the board 3 is pressed and a succeeding portion thereof remains on the feeder.

Then, the feeder 10 is urged to raise up to the shell face 51 so that the first reed 11 is pressed thereon, and the rolls 31–35 are also pressed toward the shell face, as is shown in FIG. 1(*b*).

Thence, the drum 50 and the rolls 31–35 are rotated in synchronism to advance the pressed board 3 along the drum shell face while being held mechanically. Then if a length of the board 3 is previously designed to have a same circumferential length as the drum shell 51, the initial board 3 can encircle the drum face without any excess or shortage, and thereby provide the innermost layer of a plywood product as will be apparent later.

As the next step, laminated material 1 as shown in FIG. 3(*a*) is laid on the feeder 10, which is shown in FIG. 1(*a*) at a succeeding position on the feeder. This laminated material 1 is made of layers of boards 1*a* which have an adhesive applied thereto, but remain uncured. Then, this bundle 1 is fed toward the first reed 11 to undergo in a similar way the encircling process with the initial board 3, through control of interfering mechanical fittings as noted above and thereby the laminated boards 1 and the single board 3 are pressed and fitted firmly together.

After finishing the mechanical fabrication, the rolls 31–35 and the drum 50 are stopped and relaxed. The first reed 11 is withdrawn or detached. The free rollers 21, 22, rolls 31–35, and the second reed 41 are also detached from the fabricated product, which is recovered together with the drum 50, from which the plate 52 forming the shell 51 is removed, by which the product itself is obtained.

When operating the rolls 31–35 in the above operations, the roll 31 is run the fastest, the speed of the rolls 32, 33, 34 are stepped down in that order and the roll 35 is the slowest. The two reeds, the two free rollers 21, 22 and the rolls 31–35 as noted are all controlled by respective drive units so that these elements will exert a changeable or variable pressure according to increased displacement from the shell face which takes place as thickness of the fabricated product increases. A fabricated product thus obtained will usually be subjected to curing, for instance, laying at about 80° C. for 4 hours to complete the curing process for fabrication of the intended circular frame product.

In the case of using the single lengthy, non-laminated material 2, as shown in FIG. 3(*b*), similar processings are obviously applied with care during the forming operation since the difference is in the form of the source material; that is cut and laminated material or uncut and non-laminated material. Such is overcome by those skilled in this art.

What is claimed is:

1. A process for bending and pressing a multi-layer circular frame from flat strips of wooden boards using a machine which includes:

a cylindrical forming shell removably mounted to a support rotation about an axis of the cylindrical shell;

a plurality of pressing rolls disposed opposite said forming shell and spaced circumferentially around said forming shell, said pressing rolls being movable between a position spaced radially outward of said forming shell to a position adjacent said forming shell;

a first free roller movable radially toward and away from said cylindrical shell and located between a first pressing roll and an adjacent second pressing roll;

a second free roller located between said second pressing roll and a next adjacent third pressing roll, said second free roller being movable radially toward and away from said cylindrical shell;

an elongate feeder having one end disposed for delivering one end of a flat strip of wooden board toward said first free roller, said one end of said elongate feeder having a first reed fixed thereto and being movable toward and away from said cylindrical shell, and a second reed movable toward and away from a circumferential portion of said cylindrical shell between a last one of said pressing rolls and said one end of said elongate feeder, comprising the steps of:

mounting a cylindrical forming shell to said support;

moving said first reed, said first and second free rollers and said plurality of pressing rolls to positions spaced radially outward from said cylindrical shell while moving said second reed toward said cylindrical shell;

providing a single flat strip of wooden board free of adhesive material to said elongate feeder;

moving said one end of said elongate feeder away from said cylindrical shell;

moving a forward end of said flat strip over said first reed and beyond said first free roller;

moving said first and second free rollers toward said cylindrical shell to clamp said forward end of said flat strip between said first free roller and said cylindrical shell;

moving said one end of said elongate feeder toward said cylindrical shell to press a portion of said flat strip to said cylindrical shell with said first reed;

moving said plurality of pressing rolls to their respective positions adjacent said forming shell;

rotating said cylindrical forming shell and said plurality of pressing rolls to wrap said flat strip of wooden board around said cylindrical forming shell;

providing a layered strip of wooden board to said elongate feeder, said layered strip of wooden board having adhesive applied thereto, continuing rotation of said cylindrical forming shell and said plurality of pressing rolls and feeding the layered strip toward the first reed and then advancing the layered strip through contact with said first and second reeds, said first and second free rollers and said plurality of pressing rolls to wrap said layered around said wrapped wooden board;

moving said first and second reeds, said first and second free rollers and said plurality of pressing rolls to their respective positions spaced radially outward from said cylindrical forming shell; and withdrawing said cylindrical forming shell and said wrapped, multi-layer wooden circular frame from said support.

2. Apparatus for bending and pressing a multi-layer circular frame from flat strips of wooden source material comprising:

a cylindrical forming shell removably mounted to a support for rotation about an axis of the cylindrical shell, a plurality of pressing rolls disposed opposite said forming shell and circumferentially spaced around said forming shell, said pressing rolls being movable between a position spaced radially outward of said forming shell to a position adjacent said forming shell;

a first free roller movable radially toward and away from said cylindrical shell and located between a first pressing roll and an adjacent second pressing roll;

a second free roller located between said second pressing roll and a next adjacent third pressing roll, said second free roller being movable radially toward and away from said cylindrical shell;

an elongate feeder having one end disposed for delivering one end of a flat strip of wooden source material toward said first free roller, said one end of said elongate feeder having a first reed fixed thereto and being movable toward and away from said cylindrical forming shell; and, a second reed located between a last one of said plurality of pressing rolls and said one end of said elongate feeder, said second reed being mounted for movement toward and away from a circumferential portion of said cylindrical forming shell;

whereby one end of a strip of source material is fed between said first pressing roll and said cylindrical shell to contact said first free roller, said first free roller is moved to move said one end of said source material toward said cylindrical forming shell to initiate a bending and lapping movement of said one end of said source material on said cylindrical shell and second free roller, said pressing rolls and said second reed are moved to contact and press an outer surface of said strip of source material radially inward against said cylindrical forming shell as said strip of source material is wrapped around said cylindrical forming shell.

* * * * *